US006744376B1

(12) United States Patent
Pascalidis

(10) Patent No.: US 6,744,376 B1
(45) Date of Patent: Jun. 1, 2004

(54) REMOTE INPUT/OUTPUT (RIO) SMART SENSOR ANALOG-DIGITAL CHIP

(75) Inventor: Nikolaos P. Pascalidis, Silver Spring, MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 09/383,911

(22) Filed: Aug. 26, 1999

Related U.S. Application Data

(60) Provisional application No. 60/097,975, filed on Aug. 26, 1998.

(51) Int. Cl.[7] ..... G08C 15/00

(52) U.S. Cl. ..... 340/870.21; 340/870.11

(58) Field of Search ..... 340/870.13, 870.16, 340/501, 870.21; 250/332; 307/116; 33/366.12

(56) References Cited

U.S. PATENT DOCUMENTS 4,442,716 A * 4/1984 Coe et al. ..... 340/870.13
4,549,277 A * 10/1985 Brunson et al. ..... 33/366.12
4,818,994 A * 4/1989 Orth et al. ..... 340/501
5,449,907 A * 9/1995 McKeeman et al. ..... 250/332
5,963,975 A * 10/1999 Boyle et al. ..... 711/147
5,986,357 A * 11/1999 Myron et al. ..... 307/116
6,127,942 A * 10/2000 Welle ..... 340/870.16
6,233,532 B1 * 5/2001 Boudreau et al. ..... 340/870.21

* cited by examiner

*Primary Examiner*—Michael Horabik
*Assistant Examiner*—Hung Dang
(74) *Attorney, Agent, or Firm*—Francis A. Cooch

(57) ABSTRACT

An analog-digital, radiation-hardened, low-power Smart Sensor Data Acquisition and Control chip, specifically designed and developed for Spacecraft/Instrument Housekeeping and Controls. Sensor data (Temperatures, Voltages, Currents, Pressure, Digitals) are continuously measured, digitized, stored, and transmitted, and Control Actions (DACS, Timers, Digitals) are activated, through a standard bi-directional, digital serial bus ($I^2C$). The chip also offers a Custom or Standard (like PCI) parallel bus interface for parallel readout internally communicating to the serial bus. The chip essentially eliminates spacecraft harness, and greatly simplifies system design.

14 Claims, 5 Drawing Sheets

20

REMOTE INPUT/OUTPUT (RIO) SMART SENSOR ANALOG-DIGITAL CHIP

CROSS-REFERENCE TO RELATED APPLICATION

This application claims the benefit of prior filed copending U.S. provisional application serial No. 60/097,975, filed Aug. 26, 1998.

BACKGROUND OF THE INVENTION

The invention relates to integrated circuits and, more specifically, to a chip that permits distributed data collection of engineering housekeeping data in a spacecraft through a serial bus, thus, significantly simplifying the spacecraft's electrical wiring.

Today, however, spacecraft must be smaller, faster and cheaper than ever before. Smaller spacecraft can take advantage of smaller and less expensive launch vehicles. One major spacecraft component that scales with launch mass is the electronics. One large component of the electronics is the wire harness.

A necessary function in any spacecraft or instrument is collection of engineering housekeeping data to monitor health status. Such data include temperatures from distributed sensors and voltages and currents produced either directly from the various subsystems or from distributed transducers such as pressure transducers.

Traditionally, engineering data were collected from the distributed sensors with dedicated wires to a central processing unit, which multiplexed, digitized, stored, and finally transmitted the data. This centralized approach, however, requires heavy, complex electrical harness which can comprise miles of wire since each function monitored requires at least one pair of wires connected to the CPU. Reduction in core electronics including the wire harness can assist in maximizing instrument payload, save miles of wire, save on electronics and require less power and, hence, less power dissipation. Thus, there has been a need in the industry for a device that can reduce the core electronics, including the wire harness, associated with data collection.

The new approach of this invention is to use distributed data collection and to adopt a serial bus. A couple of meters of twisted pair can then replace a heavy, complex harness. Distributed processing lightens the burden on the central processing unit. New sensors can easily be added by just attaching to the bus and assigning a new address.

What is needed then is an integrated circuit that will enable the use of distributed data collection in the spacecraft by providing signal processing and an interface between the distributed sensors and the bus.

SUMMARY OF THE INVENTION

The present invention has been made in view of the above circumstances and has as an object to provide an integrated circuit that will enable the use of distributed data collection in a spacecraft. The enabling element for distributed spacecraft and instrument data collection is the remote input/output (RIO) chip of the invention enables distributed data collection in a spacecraft. The RIO chip may be an analog-digital, radiation-hardened, low-power integrated circuit. This smart data acquisition device provides all the signal processing and the interface from the distributed sensors to a standard serial Inter-Integrated Circuit ($I^2C$) bus or a standard parallel bus.

The RIO chip measures sensory data, e.g., temperatures using external thermistors, total ionizing dose using external radFETs or PIN diodes, voltages, currents, pressures and discretes. Its sensing capability can extend to other physical quantities such as photons, vibration, etc. The RIO chip does all the necessary signal conditioning; performs the analog to digital conversion; stores data into memory; places the data as requested on a standard serial $I^2C$ or parallel bus; and provides control actions from remote processors via Digital-to-Analog Converters (DACs), and smart digital interfaces. The RIO chip is useful for remote housekeeping, high voltage converter control, stepper motor control, and spacecraft power management. It is radiation hardened and, thus, suitable for space.

One embodiment of the chip of the invention is directed to a temperature RIO (TRIO) chip for temperature measurements only. The TRIO chip measures 16 temperature channels using external platinum resistance thermistors (PRTs). It can also measure voltages only, using an external voltage reference. The TRIO chip contains all the front-end analog conditioning circuitry, the analog multiplexer (MUX), a 10-bit analog-digital converter (A/D or ADC), memory, and both a serial $I^2C$ and standard parallel interface. The TRIO chip can operate in a fixed mode, where only a particular sensor is addressed, digitized, and read out, or in a scanning mode where all 16 sensors are sequentially and continuously scanned, digitized, and stored into self-contained memory.

The chip of the invention revolutionizes spacecraft design by greatly simplifying spacecraft health data acquisition and control functions through the use of a serial bus, essentially eliminating miles of wire harness compared to traditional centralized spacecraft architecture. The unique aspect of the RIO chip is that, currently, no such chip exists for space applications. This single chip system will be a valuable enabling technology for next-generation small spacecraft.

BRIEF DESCRIPTION OF THE DRAWINGS

The accompanying drawings, which are incorporated in an constitute a part of this specification illustrate embodiment(s) of the invention and, together with the description, serve to explain the objects, advantages and principles of the invention. In the drawings:

FIG. 2 shows the Jet Propulsion Laboratory's (JPL's) IEM of the X9000 Project which is the basis of new NASA's New Millenium planetary missions.

DETAILED DESCRIPTION

Traditionally, a satellite's electronic circuits have been organized in several subsystems, each housed in its own "black box". A more recent development in spacecraft architecture is the use of an Integrated Electronics Module (IEM) approach.

Figure 1:
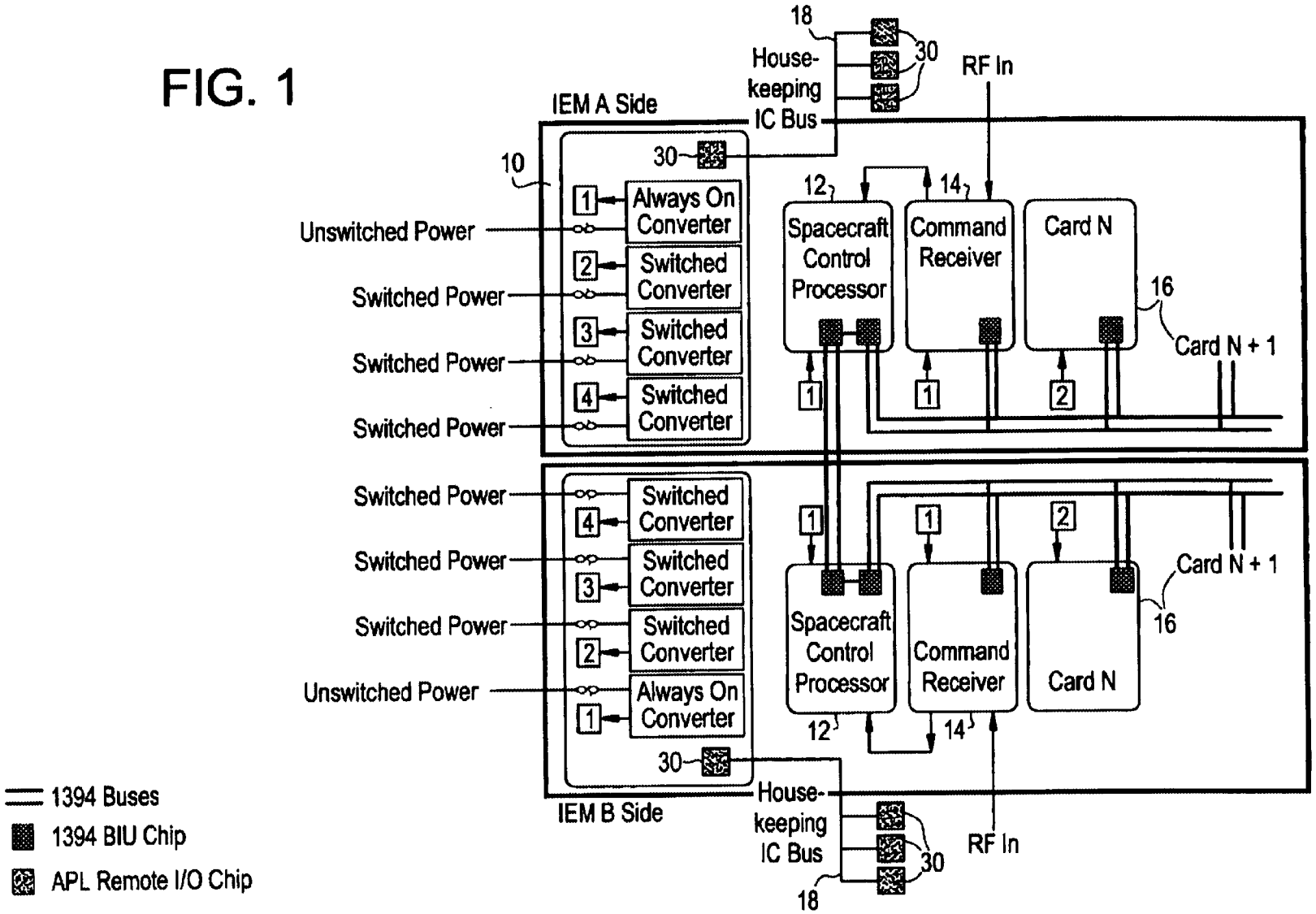
FIG. 1 is a block diagram of an integrated, scalable integrated electronics module (IEM) approach to spacecraft architecture and illustrates the use of the RIO chip in conjunction with the IEM.

FIG. 1 is a block diagram of an integrated, scalable IEM architecture 10 for use in future satellites. The IEM minimizes development costs while maximizing mission flexibility. Further, the IEM reduces most core spacecraft electronics into a single chassis that can be configured to satisfy a wide range of requirements. Each side of the IEM includes a spacecraft control processor 12 a command receiver 14, and may include additional cards 16. Each spacecraft control processor is connected to an $I^2C$ bus 18 that carries housekeeping data. RIO chips 30 of the invention are connected to the spacecraft control processors 12 contained in the IEM 10.

Figure 2:
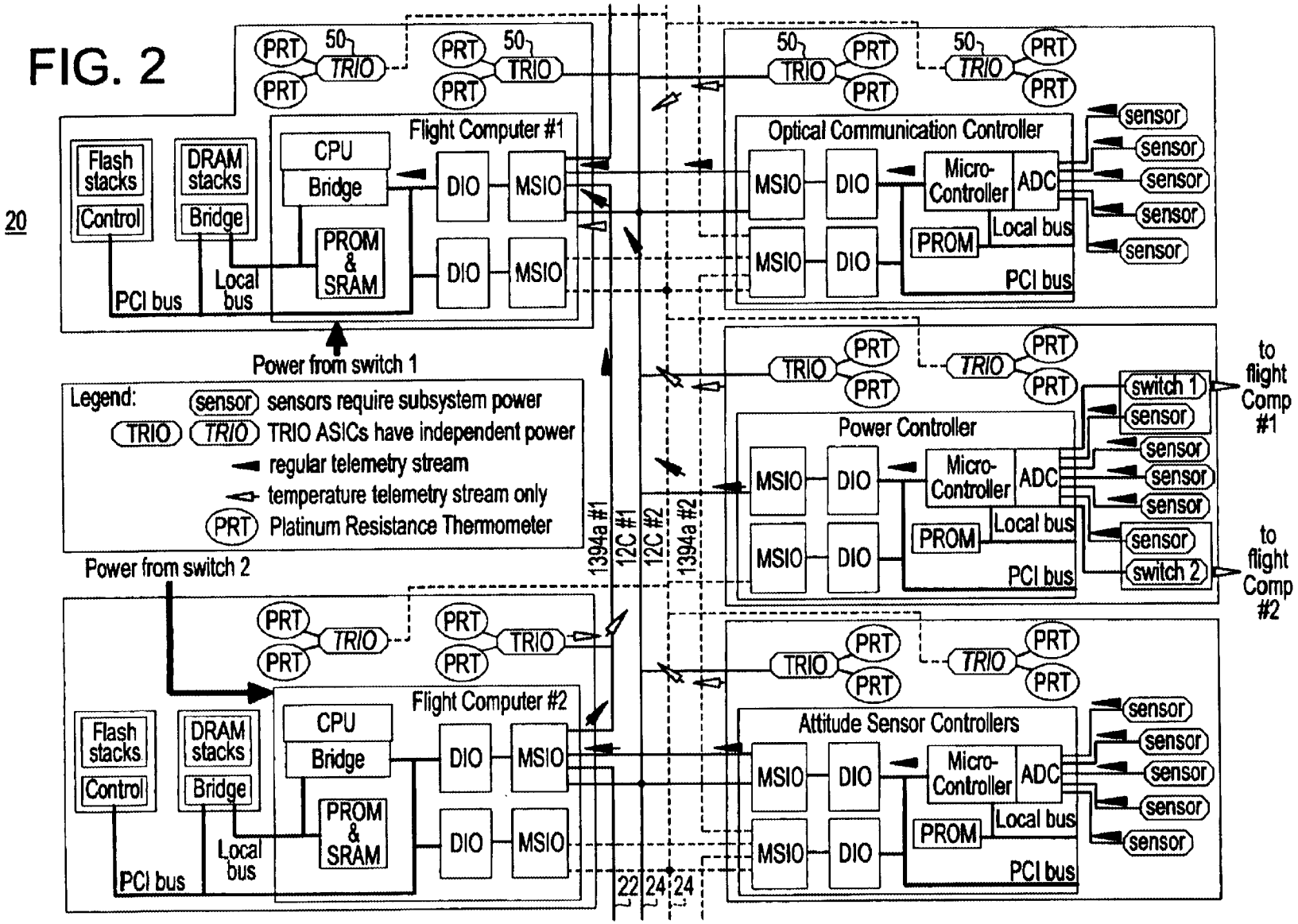
FIG. 2 is a block diagram of a spacecraft bus telemetry collection architecture utilizing the chip of the invention. More specifically.

FIG. 2 is a block diagram of a spacecraft bus telemetry collection architecture 20. It is an equivalent of the IEM 10 of FIG. 1 and was designed by John Hopkins Jet Propulsion Laboratory ("JPL") and particularly by the X9000 Project. This bus is a generic system intended to support future planetary exploration programs. The RIO chips 30 of the invention, and more specifically, the TRIO 50 of the invention is distributed throughout the bus to measure temperatures with platinum resistance thermistor sensors ("PRTS"). The X9000 spacecraft typically needs a total of about 170 temperature measurements.

A TRIO chip bare die, in the parallel readout mode, also may be used in the microcontrollers included in several spacecraft systems (Optical Communications Controller, Power Controller, etc.). In addition to temperatures, RIO chips may be used with pressure sensors in the propulsion system, and for measurements of total radiation dose profiles throughout the spacecraft.

In both of the above bus architectures, spacecraft subsystems are implemented on single circuit boards. The subsystems communicate over an EEE 1394 high-speed, low-power, serial bus 22 within the IEM. Additionally, both bus architectures use a lowspeed, low-power, digital serial bus ($I^2C$) 18 to collect status and engineering housekeeping data. The $I^2C$ bus 18 was selected for the low-speed engineering data collection because of its simplicity, reliability, and wide industrial use. The $I^2C$ bus was originally developed by Phillips Semiconductors to connect peripheral chips to microcontrollers and is widely used in industrial embedded control applications.

The $I^2C$ is a very simple bus running at two standard speeds, 100 kbps and 400 kbps. Custom implementation with enhanced drivers can increase the speed up to 4 Mbps. The $I^2C$ specification does not include provisions for data transmission error detection or correction. However, this is not significant for engineering data collection because multiple samples are commonly processed before any decision is made.

Figure 3:
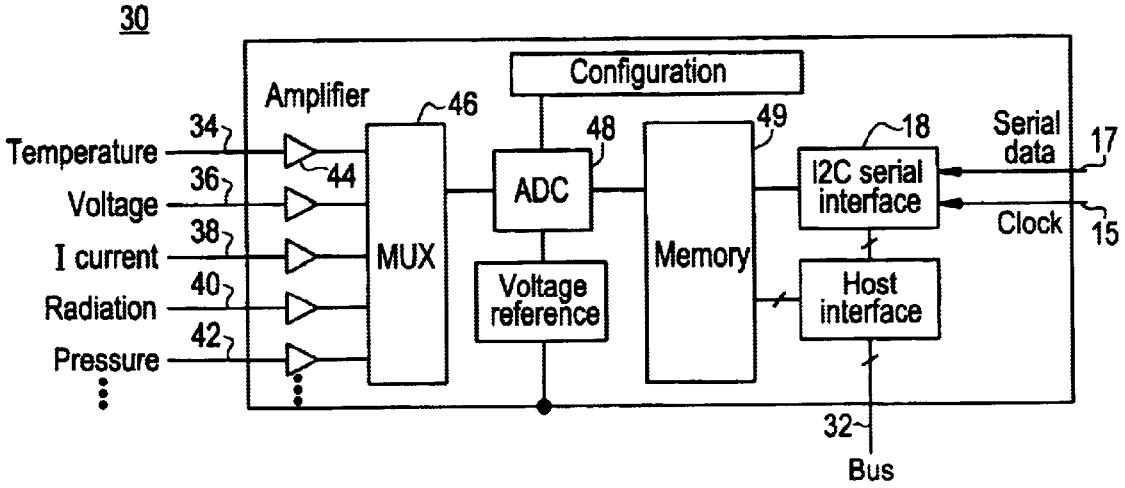
FIG. 3 is a schematic drawing of the remote input/output (RIO) chip of the invention.

The RIO chip 30 of the invention, as shown in FIG. 3, was specifically developed for distributed data acquisition. The RIO chip 30 is a general purpose, low-power, radiation-hardened, single chip, multichannel, mixed analog/digital data acquisition system that can digitize many types of sensor and engineering data. The RIO chip 30 connects directly to the $I^2C$ bus 18 for spacecraft/instrument housekeeping and spacecraft control actions. The $I^2C$ bus 18 is a standard two wire (clock 15, data 17, ground) interface. A 7-bit hard address select allows for the connection of 128 RIO+other devices on the same bus. The standard calls for two speeds, 100 KHz and 400 KHz, at a maximum bus capacitance of 400 pf. Special design was applied to push the limits at the expense of extra power, while keeping the protocol. A prototype implementation was tested to a maximum of 5 MHz, and bus capacitance of 1 nF. Measurement with 5V $V_{dd}$, indicated a power dissipation of ~2 mW @(400 Khz, 400 pf) and ~13 mW @(1 MHz, 1 nF) and ~65 mW at (5 MHz, 1 nF). The power drops down to 44% with 3.3V $V_{dd}$, as expected.

The RIO chip 30 also may connect to a standard parallel bus 32 for local microcontroller data acquisition. A standard 8-bit parallel bus 32 provides microprocessor interface and bidirectional communication with the $I^2C$ bus.

The RIO chip 30 measures sensory data including temperatures using external thermistors 34, voltages 36, currents 38, total ionizing dose using external radFETs or PIN diodes 40, pressures 42 and discretes (not shown). For temperature measurement, a thermistor must be connected from the temperature port to ground. A platinum resistor thermistor is preferable, which is linear in the entire range −2001 C to +2001 C. The 10-bit A/D conversion means a resolution of <0.51 C for this entire range. The scales according to the intended Temperature range. Any unused temperature port pins can remain unconnected. For voltage measurement, a voltage can be directly measured in the voltage port 36 as shown in the block diagram. The only requirement is that it must be externally scaled into the 0–$V_{dd}$ (In the present design: Max $V_{dd}$=5V, Min $V_{dd}$=3V). Any unused voltage port pins can remain unconnected. The resolution is $V_{dd}$/1024. Currents can be measured as small differential voltages (50 mV max) generated on external current sense resistors (not shown) connected in the ground return. The current sense resistors can also be connected at any common mode level, as soon as this is in 0–$V_{dd}$ Voltage range. Unused current port pins can remain unconnected. The resolution is 50 mV/1024, assuming that Imax maps to 50mv. The temperature port can be configured to measure voltages and vice versa. The current port can be used for anything producing a differential voltage within the 0–50 mV range. The RIO can handle any sensor that can be interchangeable with the above three mentioned types. Typically, pressure and radiation sensors produce a voltage signal and can be handled by the voltage inputs with the addition of extra bias circuitry.

The RIO chip 30 includes amplifiers 44 that receive the signals from the sensors. A multiplexer 46 then provides the signal to an analog-to digital converter (A/D or ADC) 48 which digitizes the measurements, which are then stored in a memory 49. Currently a 10-bit A/D (10 true bits) is applied, available in two conversion speed options, 10 $\mu$s and 100 $\mu$s. The A/D is specifically designed to autozero for radiation and temperature induced effects as well as to operate in a substrate with mixed analog/digital signal processing. The same applies to all front end signal acquisition and conditioning electronics. The memory again is specifically designed to achieve the high levels of SEU thresholds.

The sensing capability can extend.to any other physical quantity that can be transduced to voltage or current form. The RIO chip can also contain digital-to-analog converters, analog and digital comparators, counters, programmable timers, and smart digital interface to perform local control actions.

A control port (not shown) includes four DAC-Comparator-Counter channels that are available for monitoring external threshold crossing conditions and taking control actions. Each DAC is 6-bit, and each comparator has a build in histolysis of -loom. Four Timer outputs T1 to T4 are also available for actions like microthruster controls, motor controls, valves, etc. Each timing output, T1 to T4, can generate a defined number of pulse trains, "n=1 to 256," with a settable duty cycle "It/T=0% to 100% in 256 steps".

A general purpose digital I/O port is also available, which can be configured for monitoring digital status and setting digital conditions to external devices, acting actually as a microcontroller. Extra I/Os are configured as timer outputs suitable for pulsed or continuous thruster control.

Figure 4:
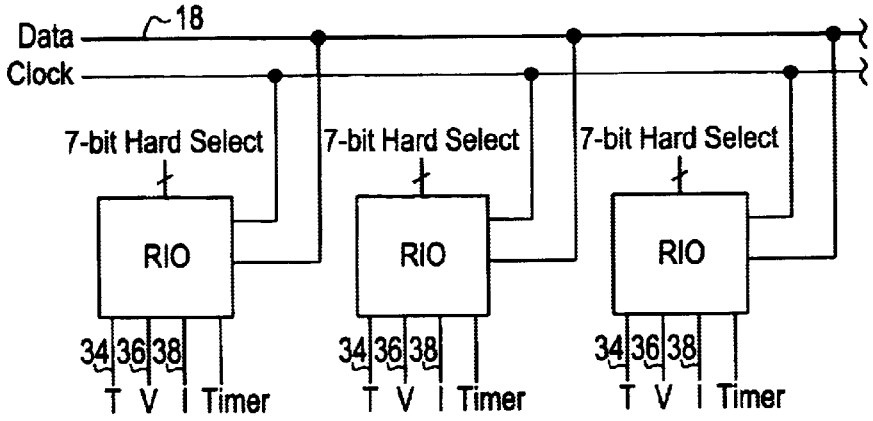
FIG. 4 illustrates several RIO chips cascaded on an $I^2C$ serial bus.

The serial communications bus 18 by nature saves a huge amount of harnessing required in a traditional spacecraft design. As shown in FIGS. 2 and 4, this bus 18 allows cascading of many sensors and actuators without additional wiring. It is expected, based on past experience, that special care in the design combined with fabrication in a radiation hardened process, will provide a total dose radiation hardness of up to 1 Mrad, LET thresholds of −120 MeV.=**2/mg, and latch up immunity.

A general description of the RIO chip shown in FIG. 3 has the following features:

- A sensor port for temperatures, voltages, currents, radiation, pressure, etc., transducers. The number of inputs per sensor type is flexible but a good approach is 8 inputs/sensor type.
- Four analog comparator-counter inputs to count threshold crossings.
- Four digital-to-analog outputs to independently set the comparator thresholds and provide control actions.
- A 24-bit digital input-output port.

The chip is addressable and can be networked with sister housekeeping chips on a "party line". The chip can operate in two modes: random and scan. In random mode, the chip will be instructed to return the value of a specific channel only. In "scan model", the chip will be return values for all channels when polled.

The RIO chip of the invention is useful in that it allows remote monitoring and control of subsystems that would previously have required a dedicated processor or large amounts of discrete electronics. Such applications-include: high voltage power supplies, simple motor control applications (shutters, motors), power management systems, instrument housekeeping, local measurements of temperatures, relay control, etc.

Figure 5:
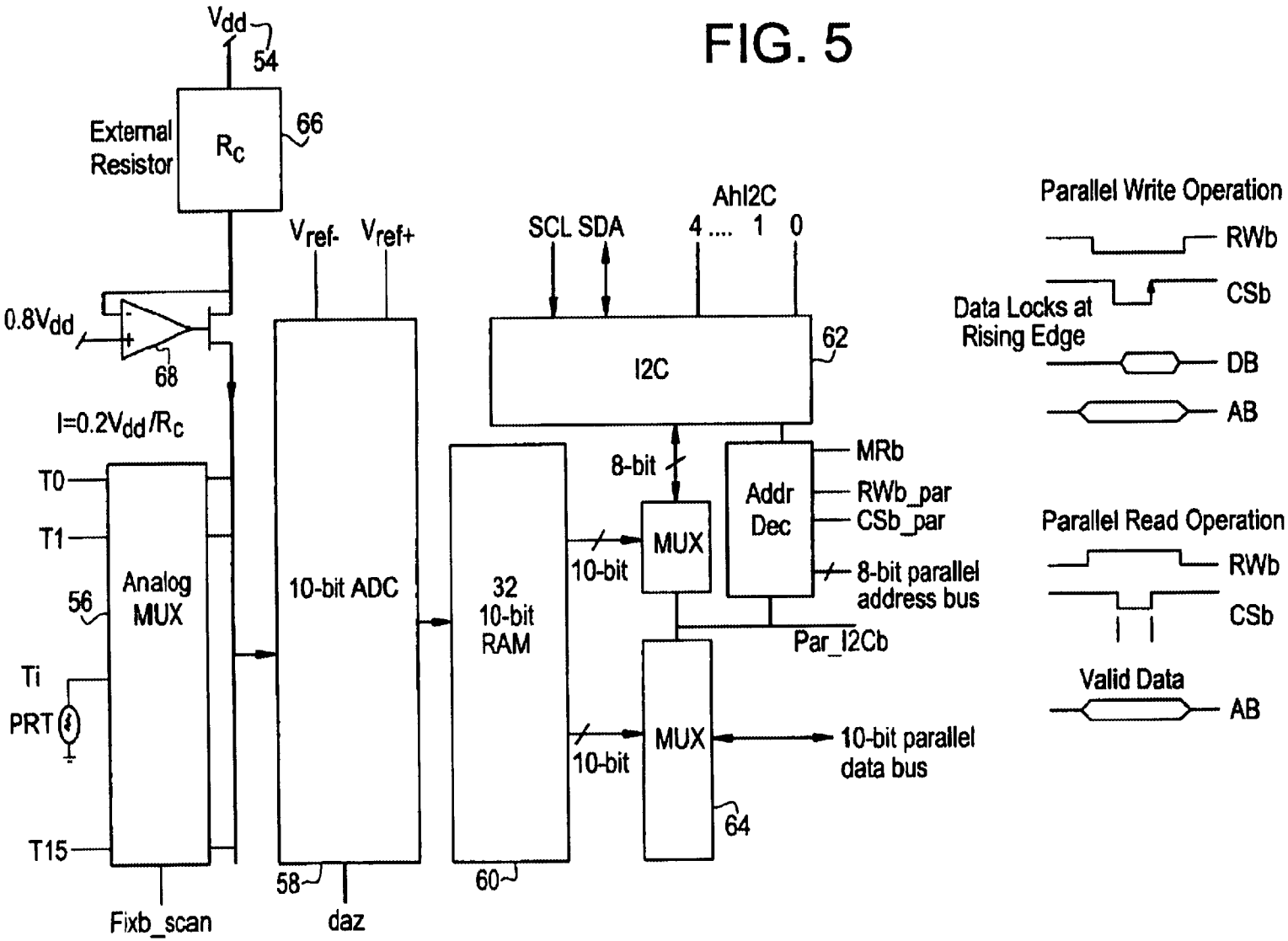
FIG. 5 is a block diagram of the TRIO chip embodiment of the invention.

One embodiment of the RIO chip is directed to making temperature measurements. The temperature RIO (TRIO) chip is shown in FIG. 5. The TRIO chip measures 16 temperature channels T0 to T15 using external platinum resistance thermistors (PRTs) 52. It can also measure voltages only, using an external voltage reference 54. The TRIO chip contains all the front-end analog conditioning circuitry, the analog MUX 56, a 10-bit ADC 58, memory 60, and both a serial $I^2C$ 62 and a standard parallel interface 64.

The TRIO can operate in a fixed mode where only a particular sensor is addressed, digitized, and read out, and in a scanning mode where all 16 sensors are sequentially and continuously scanned, digitized, and stored into memory. The memory then can be independently read out from either the serial or the parallel interface.

Generally, a voltage measurement is a comparison and digitization against a stable voltage reference. Similarly, a temperature measurement can be a comparison of a temperature sensitive passive resistive element against a temperature insensitive element. In the TRIO, each high temperature coefficient PRT element 52 is compared against a very low temperature coefficient resistor Rc 66.

The front end circuitry interfaces to the sensors, providing the required biasing and signal conditioning for interfacing to the ADC. The temperature measurement is based on a current source defined by an opamp 68 and resistor $R_C$ 66. Resistor $R_C$ is connected from the negative terminal of the opamp 68 to the $V_{dd}$ 54 rail. The positive terminal of the opamp 68 is set to $0.8V_{dd}$ with a resistive voltage divider from rail to ground. With this connection, the value of the current source is $0.2\ V_{dd}/R_C$, and therefore is linearly dependent on $V_{dd}$ 54. The current is forced through the analog multiplexer 56, sequentially to each of the PRTs 52 connected to the T0–T15 terminals. The voltage developed on each PRT 52 is therefore:

$$V_{temp}=0.2V_{dd}*R_{PRT}/R_C \tag{1}$$

From this equation it is clear that the power supply dependence of $V_{dd}$ 54 can be easily compensated for by making the reference voltage of the ADC be power supply dependent. It is clear that $R_C$ should be selected with a temperature coefficient much less than PRT 52, in order to compensate for operational temperature variations. $R_C$ is a small size chip resistor external to the TRIO chip. To be more precise, the temperature coefficients of the PRT 52 should be >2*1024 that of $R_C$for a 10-bit resolution ADC and <0.5 LSB error, assuming the same temperature extremes for the PRTs and $R_C$. The value of $R_C$ also sets the scale of the current in order to normalize the various PRT voltage values to the ADC voltage conversion range. Changing the value of $R_C$ allows adjustment of the temperature which is measured.

There are commercially available low-cost, mil-spec PRTs that are highly linear in a broad temperature range with a broad range of nominal ice temperature values. One such commercially available PRT is from Rosemount Aerospace, with an ice temperature value of 5 k__, and linear in the temperature range −200 to +200° C. The temperature variation is −+20__/° C. and the temperature coefficient is +4000 ppm. Equation (1) then-says that the temperature coefficient of $R_C$, should be <2 ppm.

The analog multiplexer 56 is composed of large CMOS switches to achieve low ON resistance. The value of the switch resistance does not affect the accuracy of the measurement because the temperature voltage is sensed on the sensor after the switch. However, it is important to have low ON resistance value, compared to the PRT 32, in order to contribute less to saturation and to increase the speed in the voltage transfer mode. The multiplexer 56 can be configured to operate in a fixed or a scanned mode. In the fixed mode, only a particular sensor is addressed and read out. In the scan mode all the sensors are scanned, digitized, and sequentially stored into on-chip memory.

The time constant associated with the development of the temperature voltage is $_{temp}$,=$R_{PRT}*C_T$, due to the total capacitance $C_T$ at each node. The capacitance $C_T$ is mostly due to the twisted pair from the TRIO chip to the PRT. A typical value is approximately 200 pf/m. Thus, there is a wait time needed for each sensor before starting the ADC, to achieve any desired resolution. For a 10-bit ADC, assuming a 0.1 LSB accuracy, the maximum wait time needed is:

$$t_w/_{temp}>-1n(0.1/2^{10})9.2 \tag{2}$$

For a maximum $R_{PRT}$, resistance value of 10 k__, $t_w$ is >18.4 $\mu$s per meter. The wait time is programmable, based on the conversion clock, to accommodate different loads and PRT values.

The ADC digitizes the voltage generated by the front end signal conditioning circuitry. The topology was selected for rail-to-rail input dynamic range, good linearity, monotonicity, and low power. Speed is not critical for this application, so it was sacrificed for low power and simplicity.

The selected topology also minimizes the effects of total radiation dose. The ADC is a 10-bit successive approximation type. The operation is based on a 10-bit DAC, a comparator, and a successive approximation algorithm. The DAC comprises a resistive ladder and analog switches. The comparator is designed for rail to-rail input common mode voltage and low offset.

The only ADC function that can be influenced by total radiation dose is that of the comparator. Special care was taken in the layout and in the biasing of the comparator to minimize dose effects, using experimental results and experience gained from past optimized designs. To further reduce offset related errors, the ADC was provided with an optional digital autozeroing mode, (controlled by pin "dazll) with a small cost in conversion speed.

The ADC performs conversions between $V_{ref-}$ and $V_{ref+}$, which can be externally set by the user. For the temperature measurement, the difference $V_{ref-}-V_{ref+}$, must be $V_{dd}$ dependent in order to compensate for its variation. A simple way to apply this is to connect $V_{ref-}$ to ground and $V_{ref+}$, to $V_{dd}$. The ADC can operate in the power supply range 3–5 volts. The clock can be externally provided or internally generated. The maximum conversion rate is approximately 25 k samples/sec, and the power dissipation is approximately 5 mW at 5 volts.

The digitized information is stored in 10-bit memory registers. There are 32 locations available, anticipating extension of the number of sensors in a next embodiment of the chip. The memory is written by the ADC, and read out independently by the parallel or the serial interface. Special design care was taken to avoid write/read timing conflicts as well as to minimize Single Event Upsets.

The TRIO chip has two selectable modes of read out: a serial $I^2C$ interface and a standard parallel interface. The serial interface is advantageous for remote data collection, whereas the parallel interface is best for local microcontroller applications. The parallel bus has a standard 8-bit address bus, 10-bit data bus, and the required strobe signals. The $I^2C$ interface is a compact custom design, with special output driver implementation to boost the speed up to 4 Mbps, well beyond the maximum spec of 400 Mbps. This capability was added to anticipate use with high bandwidth sensors.

Fault protection is obviously very important in a serial bus application. A special driver design also protects the bus against device failure. In case of a bus short, each device performs an autocheck, and if it is responsible for the bus failure it is self-isolated.

The current $I^2C$ implementation has a hard select address depth of 5-bits, which allows addressing 32 slave TRIO devices, with a provision to extend to 7-bits (128 devices). The $I^2C$ functionality can be enhanced to a master capability, in order to allow operation in a multimaster bus. In a multimaster bus, each device will act independently as a master to allow decision actions, alarm settings, etc. This will increase the "smartness" of the device.

The TRIO chip can measure temperatures only or voltages only. The voltage measurement, however, needs an external voltage reference for the ADC since there is not one available on chip in this embodiment. The temperature measurement does not need a voltage reference because the reference element is the low temperature coefficient resistor $R_C$.

Voltage sources to be measured should be connected to terminal T0 through T15. Voltage mode is achieved simply by disconnecting the external resistor element $R_C$. in order to allow the ADC input to be determined by the corresponding voltage source (see FIG. 5). In addition, to save power, the current source operational amplifier can be turned off by simply disconnecting its biasing. Future RIO chip embodiment will have a simple commandable selection of the voltage mode. It is assumed that each voltage source to be measured has a value within the ADC voltage reference window $V_{ref-}$ and $V_{ref+}$; also it should be $V_{ref-}>0V$, $V_{ref+}<V_{dd}$ and $V_{ref-}<V_{ref+}$. Each input T0–T15 has a built in overvoltage protection.

Temperature measurement errors can result from variation of the input offset voltage, Vf, of the current source operational amplifier, the non-linear part, $R_{PRTn1}(T)$, of the PRT resistance versus temperature, the variation of the input offset voltage $V_{ofcmp}$ of the ADC comparator, and the non-linearity of the ADC. ADC non-linearity error can be measured for each chip, and if necessary, removed by post-calibration. In the temperature measurement mode, the sum of errors at the input of the ADC can be seen in the equation:

$$V_{temp}=(0.2\ V_{dd}-V_{ofcmp})*(R_{PRT}+P_{RTn1}(T)R_C+V_{ofcmp} \quad (3)$$

Any non-linear $R_{PRT}$ variation can be calibrated for, if necessary, by a look-up table. However, as discussed above, there are available PRTs with excellent linearity within a broad temperature range. Comparator offset can be removed by operating the ADC in the autozeroing mode, with some conversion speed penalty.

There is a convenient way to remove both offset induced errors by simply using a low temperature coefficient resistor, identical to $R_C$, as a calibration sensor in one of the sixteen channels. This calibration sensor should correspond to a fixed temperature and therefore any electronically induced error can be removed, based on the known temperature.

In the voltage mode, sources of error are the offset variation of the ADC comparator (which can be removed by operating the ADC in the autozeroing mode), the variation in the ADC reference voltage, and the ADC non-linearity.

Figure 6:
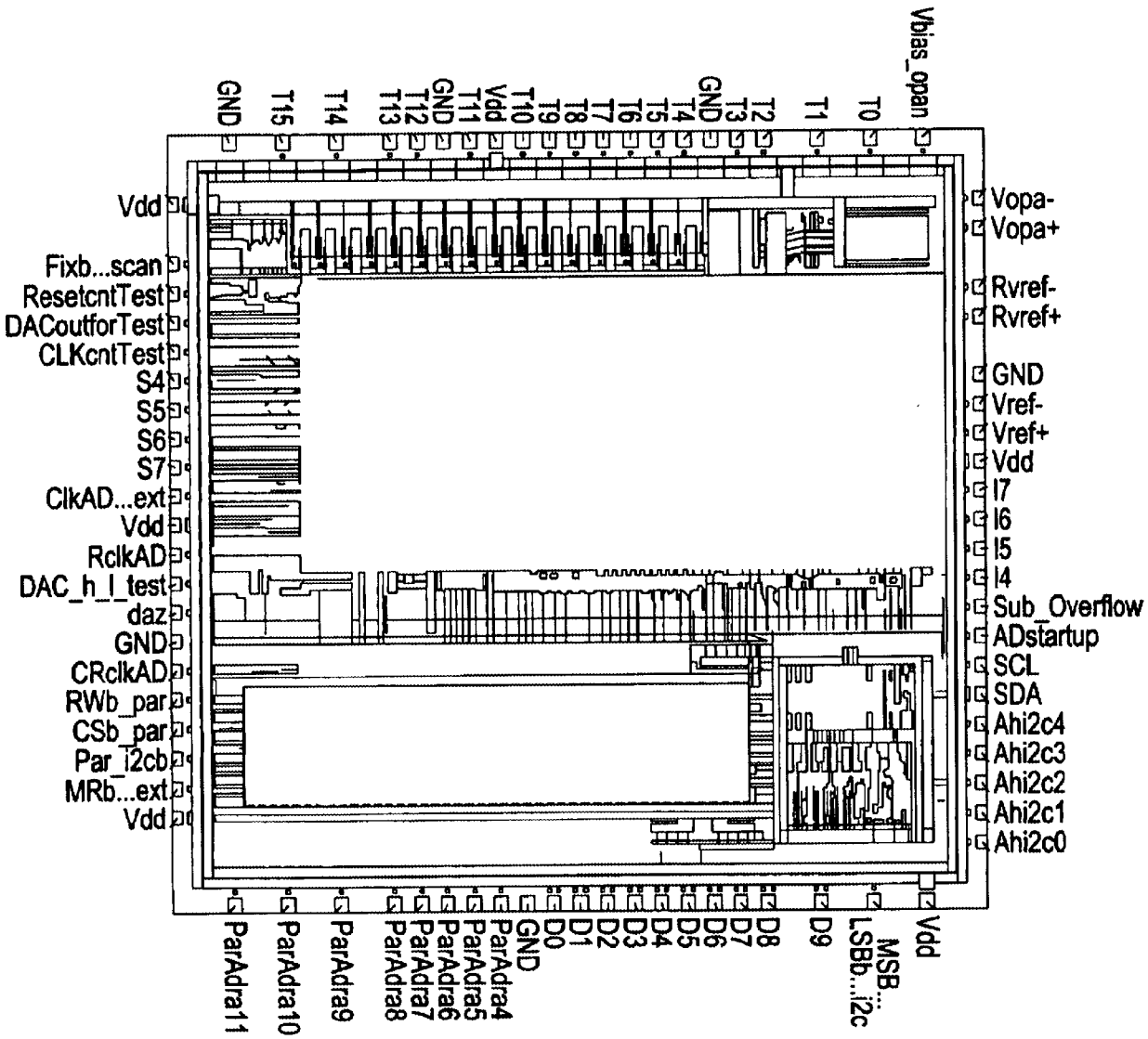
FIG. 6 illustrates the TRIO chip die bonding diagram.

The pin descriptions for the TRIO chip, as is shown in the bonding diagram of FIG. 6, follow:

$V_{dd}$ Positive: power supply pins (+5V)

GND: (Substrate) ground pins.

T0 . . . T15: (analog pins) Temperature Sensor Inputs (or single ended Voltages), 16 single ended channels; Connect a thermistor temperature sensor; a switched current source produces a temperature dependent voltage on each sensor, which is AJ) converted, stored, and read out. If pin Vbias opan is connected to GND, then the current source is neutralized and pins T0 to T15 can measure single ended Voltages.

Vbias-opan: (analog pin) Current source operational amplifier bias; for Temperature measurement connect a resistor to $V_{dd}$; a50K value it is suggested; for Voltage measurement connect to ground in order to neutralize the current source.

Vopa-: (analog pin) Negative input of the current source operational amplifier; Connect a Temperature independent resistor, Rb, to $V_{dd}$ to define the current source strength. The magnitude of the resistor determines the temperature scale and the temperature measurement resolution; a voltage value of $\mathbf{0}.^8V_{dd}$ is internally maintained at this pin; a value of Rb-0.5 K and a mean thernistor value of IK, leads to a mean voltage on the sensor of 2V @$V_{dd}$=5V.

Vopa+: (analog pin) Positive input of the current source operational amplifier; An internal voltage divider sets the voltage at this pin to $0.8V_{dd}$; this value can be externally trimmed; this voltage value along with the value of Rb determines the strength of the current source.

Rvref−: (analog pin) One end of an internal metal resistor string to be optionally connected to pin Vref−; the other end is connected to GND; helps to adjust upwards the AD window with the same temperature coefficient resistor.

Rvref+: (analog pin) One end of an internal metal resistor string to be optionally connected to pin Vref+; the other end is connected to $V_{dd}$; helps to adjust downwards the AD window with the same temperature coefficient resistor.

Vref−: (analog pin) Negative threshold of the AD converter; connect to GND or to pin Rvref− for adjustable resolution. Vref+ (analog pin) Positive threshold of the AD converter; connect to $V_{dd}$ or to pin Rvref+ for adjustable resolution.

14 . . . 17: (digital input pin) The MSB part of an 8-bit word (the LSB is internally set to 0000) which determines the time interval (in clock periods) from the moment of switching to a new sensor to the moment of the AD conversion; this is important in order to compensate for any RC associated delay on the sensor in order for the voltage to reach its final value with the desired resolution, before the AD conversion.

s4 . . . s7: (digital input pin) The MSB part of an 8-bit word (the LSB is internally set to 0000) which determines a delay (in clock periods) for the second AD conversion in the autozeroing mode; effective only if pin daz is 'high'.

sub-overflow: (digital output pin) Diagnostic for the AD autozeroing mode.

Adstartup: (digital input pin) Optional external AD startup pin; the AD starts conversion either after a Master Reset (hard or soft) or pulling this pin down at the rising edge of the pulse; if not used, set it 'high'.

SCL: (digital input pin Schmitt trigger) Serial Clock input of the IIC interface. SDA (digital input pin) Serial Data input—output pin of the IIC interface.

Ahi2cO Ahi2c4: (digital input pin) Hard select pins for the iic interface; up to 32 devices can be addressed.

MSB-LSBb-i2c: (digital input pin) When 'low', i2c reads out the BLSB of the 10 bit memory word; ) When 'high' i2c reads out the BMSB of the 10 bit memory word.

DO D9: (digital input—output pins) 10-bit bi-directional data bus.

ParAdra4 ParAdrall: (digital input pin) B-bit parallel address bus; ParAdra4 LSB, ParAdrall MSB. T0 address 00, T15 address OF. FE is the address of the Temperature pointer register; this register is used to set the temperature pointer in the fixed mode.

MRb-ext: (digital input pin) External hard master reset.

Par-i2cb: (digital input pin) When 'high, parallel read out; when "low' serial read out.

CSb: (digital input pin) Chip select; when low readout data valid on the bus; write action at the rising edge.

rwb (digital input pin) Read—Write strobe; 'high" read mode; 'low" write mode.

CrclkAl: (analog pin) The CR node of the internal clock generator; connect an external capacitor to GND to define the clock speed.

Daz: (digital input pin) If 'high' the AD is in the autozeroing mode; if 'low" the AD is in the non-autozeroing mode.

DACh-l-test: (digital input pin) Pin for testing the DAC speed; switch this pin between 'low, and 'high" to monitor the DAC response at its two extremes on pin DACoutforTest.

RalkAD (analog pin) The R node of the internal clock generator; connect this pin directly or through an extra resistor to pin CrclkAD in order to activate the internal clock generator. CLkAD-ext (digital input pin) Pin to apply an external clock; if kept 'low' the clock generator is not active.

CLKcntTest (digital input pin) Diagnostic for testing the DAC response; Apply an external clock to monitor the DAC ramp on the pin DACoutforTest. Keep high for normal operation. DACoutforTest (analog pin) The DAC output of the AD converter for testing purposes.

ResetcntTest (digital input pin) Pin to reset the counter for testing the DAC; in order to monitor the DAC output keep this pin 'high'.

Fixb-scan (analog input pin) When 'high' the system is in the scanning mode—all sensors are sequentially measured, digitized and stored; the sensor pointer increments automatically from the 00 value after a Master Reset. When 'low" the system is in the fixed mode—only a certain sensor determined either parallelly or serially is measured; the sensor address is determined by the sensor pointer.

The invention's mixed analog-digital custom integrated circuit technology can play an important enabling role in the development of next-generation compact, lightweight, low-power, autonomous spacecraft. By mastering this technology, a complex circuit can be reduced to a microchip that can be space qualified and flown.

The invention allows distributed data acquisition and serial transmission, thus eliminating complex and heavy harnessing and simplifying spacecraft design. This single chip system will be a valuable enabling technology for next-generation small spacecraft.

The general purpose single chip of the invention can revolutionize spacecraft design. It is also a paradigm of a system on a chip, which finally can bring to reality the concept of the spacecraft on a chip.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An integrated circuit for use in distributed data collection in a spacecraft comprising:

a plurality of ports for receiving sensor signals, said ports being connected to a plurality of sensors in the spacecraft wherein at least one of said plurality of sensors is a temperature sensor wherein a temperature measurement does not require a voltage reference due to the presence of a low temperature coefficient resistor external to said integrated circuit;

a multiplexer having a plurality of inputs and an output, each of said ports being connected to one of said inputs of said multiplexer;

an analog-to-digital converter having an input and an output, said input of said analog-to-digital converter being connected to said output of said multiplexer, said analog-to-digital converter comprising a radiation-hardened comparator;

a radiation-hardened voltage reference connected to said analog-to-digital converter;

a memory connected to said output of said analog-to-digital converter; and a serial bus connected to said memory.

2. An integrated circuit for use in distributed data collection in accordance with claim 1, further comprising a plurality of amplifiers connected between said plurality of ports and said inputs to said multiplexer.

3. An integrated circuit for use in distributed data collection in accordance with claim 1 further comprising a parallel bus connected to said memory.

4. An integrated circuit for use in distributed data collection in accordance with claim 1 wherein said at least one temperature sensor is a thermistor.

5. An integrated circuit for use in distributed data collection in accordance with claim 1 herein said plurality of sensors include voltage sensors.

6. An integrated circuit for use in distributed data collection in accordance with claim 1 wherein said plurality of sensors include current sensors.

7. An integrated circuit for use in distributed data collection in accordance with claim 1 wherein said plurality of sensors include radiation sensors.

8. An integrated circuit for use in distributed data collection in accordance with claim 1 wherein said plurality of sensors include pressure sensors.

9. An integrated circuit for use in distributed data collection in accordance with claim 1 wherein said plurality of sensors include at least two sensors from the group of a voltage sensor, a current sensor, a radiation sensor, and a pressure sensor.

10. An integrated circuit for use in distributed data collection in accordance with claim 1 wherein said multiplexer is an analog multiplexer.

11. An integrated circuit for use in distributed data collection in accordance with claim 1 wherein said serial bus is an $I^2C$ serial bus.

12. An integrated circuit for use in distributed data-collection in accordance with claim 1 wherein said integrated circuit is radiation-hardened.

13. An integrated circuit for use in distributed data collection in a spacecraft comprising a plurality of sensors, the integrated circuit comprising:

a plurality of ports connected to said plurality of sensors in the spacecraft wherein at least one of said plurality of sensors is a temperature sensor wherein a temperature measurement does not require a voltage reference due to the presence of a low temperature coefficient resistor located external to said integrated circuit;

a multiplexer connected to each of said plurality of ports;

an analog-to-digital converter connected to said multiplexer;

a memory connected to said analog-to-digital converter; and a serial bus connected to said memory.

14. An integrated circuit in accordance with claim 13 wherein said sensors include at least two from the group of a temperature sensor, a voltage sensor, a pressure sensor, a current sensor, and a radiation sensor.

* * * * *